US010893710B2

(12) United States Patent
Beck

(10) Patent No.: US 10,893,710 B2
(45) Date of Patent: Jan. 19, 2021

(54) TACTICAL HAND WARMER APPARATUS

(71) Applicant: TYR Tactical, LLC, Peoria, AZ (US)

(72) Inventor: Jason Beck, Peoria, AZ (US)

(73) Assignee: TYR Tactical, LLC, Peoria, AZ (US)

( * ) Notice: Subject to any disclaimer, the term of this patent is extended or adjusted under 35 U.S.C. 154(b) by 0 days.

(21) Appl. No.: 16/200,915

(22) Filed: Nov. 27, 2018

(65) Prior Publication Data

US 2019/0090557 A1 Mar. 28, 2019

Related U.S. Application Data

(63) Continuation of application No. 14/522,825, filed on Oct. 24, 2014, now Pat. No. 10,136,685.

(51) Int. Cl.

| | |
|---|---|
| ***A41D 13/05*** | (2006.01) |
| ***A41D 13/08*** | (2006.01) |
| *A41D 13/00* | (2006.01) |

(52) U.S. Cl.

CPC ..... *A41D 13/08* (2013.01); *A41D 13/081* (2013.01)

(58) Field of Classification Search

CPC ..... A41D 13/08; A41D 13/081; A41D 19/01; A41D 19/002; A41D 19/0034; A41D 19/01594; A41D 19/0048; A41D 19/001; A41D 19/0041; A41D 19/0037; A41D 19/0044; A41D 19/0003; A41D 19/0082; A41D 19/0093; A41D 19/01552

See application file for complete search history.

(56) References Cited

U.S. PATENT DOCUMENTS

| | | | | |
|---|---|---|---|---|
| 1,507,707 | A * | 9/1924 | Morganstern | A47K 7/02 15/227 |
| 2,321,091 | A * | 6/1943 | Kertesz | A41D 13/081 2/159 |
| 2,611,901 | A * | 9/1952 | Neider | A41D 19/01 2/158 |
| 3,292,016 | A | 12/1966 | Kafka | |
| 4,405,355 | A * | 9/1983 | Singer | A01N 47/28 504/195 |
| 4,408,355 | A | 10/1983 | Brock | |
| 4,426,739 | A * | 1/1984 | Wadsworth | A41D 13/08 2/16 |
| 4,495,659 | A * | 1/1985 | Madnick | A41D 13/081 2/66 |
| 4,543,671 | A * | 10/1985 | Monk | A41D 19/01535 2/158 |

(Continued)

FOREIGN PATENT DOCUMENTS

| | | |
|---|---|---|
| DE | 9409402 | 1/1985 |

OTHER PUBLICATIONS

Extended European Search Report in corresponding Euriopean App No. 15151336.3 dated Mar. 29, 2016.

(Continued)

*Primary Examiner* — Robert H Muromoto, Jr.
(74) *Attorney, Agent, or Firm* — KW Law, LLP

(57) ABSTRACT

The tactical hand warmers may have a first glove portion defining a first glove recess that is detachably connected to a second glove portion defining a second glove recess for allowing an individual to warm their hands within the first and second glove recesses either closely together when the first and second glove portions are attached or apart when the first and second glove portions are detached.

11 Claims, 6 Drawing Sheets

(56) References Cited

U.S. PATENT DOCUMENTS 5,139,187 A * 8/1992 Fowler ..... A45C 9/00 224/576
5,682,610 A * 11/1997 Warner ..... A41D 19/01 2/158
6,385,775 B1 * 5/2002 Komjati ..... A41D 15/04 2/86
D528,784 S * 9/2006 Beck ..... D3/221
7,266,850 B1 * 9/2007 Strum ..... F41H 1/02 2/2.5
D572,465 S * 7/2008 Beck ..... D3/215
D584,893 S * 1/2009 Beck ..... D3/215
7,490,358 B1 * 2/2009 Beck ..... A41D 13/0531 2/102
9,394,080 B2 * 7/2016 Beck ..... B65D 21/08
9,435,614 B2 * 9/2016 Beck ..... F41H 1/02
2008/0023614 A1 * 1/2008 Beck ..... F21L 2/00 248/444
2010/0025560 A1 * 2/2010 Beck ..... A45F 5/02 248/558
2010/0299800 A1 * 12/2010 Jackson, Jr. ..... A41D 13/081 2/69
2011/0155076 A1 * 6/2011 Charette ..... A41D 19/0017 119/795
2012/0042428 A1 * 2/2012 Jarboe ..... A41D 13/085 2/16
2013/0115393 A1 * 5/2013 Beck ..... A45F 3/06 428/35.2
2013/0143460 A1 * 6/2013 Beck ..... F41H 5/0485 442/239
2013/0160185 A1 * 6/2013 Narboni-Campora ..... A41D 19/01 2/158
2013/0256358 A1 * 10/2013 Beck ..... F41H 1/02 224/641
2014/0173804 A1 * 6/2014 Matos ..... A41D 19/0034 2/158
2014/0262842 A1 * 9/2014 Beck ..... B65D 21/08 206/3
2015/0082503 A1 * 3/2015 Beck ..... F41H 1/02 2/2.5
2015/0320150 A1 * 11/2015 Beck ..... A44B 13/0029 24/647
2015/0320182 A1 * 11/2015 Beck ..... A45F 3/04 24/644
2016/0113335 A1 * 4/2016 Beck ..... A41D 13/08 2/16

OTHER PUBLICATIONS

Gemma: Flutter and Sparkle: A very Wintry OOTD with Joe Browns; Dec. 27, 2011 www.flutterandsparkle.com/2011/12/very-wintry-ooted-with-joe-browns.html.
Non-Final Office Action from the United States Patent and Trademark Office for U.S. Appl. No. 14/522,825 dated Jan. 29, 2016 (15 pages).
Office Action from the United States Patent and Trademark Office for U.S. Appl. No. 14/522,825 dated Nov. 14, 2016 (11 pages).
Non-Final Office Action from the United States Patent and Trademark Office for U.S. Appl. No. 14/522,825 dated Jun. 7, 2017 (12 pages).
Office Action from the United States Patent and Trademark Office for U.S. Appl. No. 14/522,825 dated Mar. 22, 2018 (12 pages).
Notice of Allowance from the United States Patent and Trademark Office for U.S. Appl. No. 14/522,825 dated Jul. 23, 2018 (6 pages).
Office Action from the Canadian Intellectual Property Office for Application No. 2,877,379 dated Nov. 4, 2019 (5 pages).

* cited by examiner

TACTICAL HAND WARMER APPARATUS

CROSS-REFERENCE TO RELATED APPLICATIONS

This application is a continuation of U.S. Ser. No. 14/522,825, filed on Oct. 24, 2014, entitled Tactical Hand Warmer Apparatus and issued as U.S. Pat. No. 10,136,685 which is herein incorporated by reference in its entirety for any purpose.

FIELD

The present disclosure generally relates to hand warmer apparatus, and in particular to a hand warmer apparatus having two separable hand warming portions.

BACKGROUND

Typically, tactical hand warmers may be single-piece muffs with opposing open ends that permit a soldier to insert their hands closely together to keep them warm. However, the demands of a combat or tactical environment may require the individual to maintain their hands apart from each other, rather than being closely held together in the single-piece muff. As such, there is a need for a tactical hand warmer that permits the soldier to maintain their hands either closely together or far apart to keep them warm.

SUMMARY

In some embodiments, a tactical hand warmer apparatus may include a first glove portion defining a first open end and a second closed end, wherein the first open end forms a first opening in communication with a first glove recess defined by the first glove portion and configured to receive a hand of an individual. In addition, the tactical warmer apparatus includes second glove portion defining a first open end and a second closed end, wherein the first open end forms a second opening in communication with a second glove recess defined by the second glove portion and configured to receive another hand of the individual. Finally, a securing arrangement extends along a first end portion of the first glove portion and the second end portion of the second glove portion for engaging or disengaging the first glove portion and the second glove portion.

In some embodiments, a method of manufacturing a tactical hand warmer apparatus may include:

- forming a first glove portion defining a first open end and a second closed end wherein the first open end forms a first opening in communication with a first glove recess defined by the first glove portion;
- forming a second glove portion defining a first open end and a second closed end wherein the first open end forms a second opening in communication with a second glove recess defined by the second glove portion; and
- forming a securing arrangement for detachably coupling the first glove portion relative to the second glove portion.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
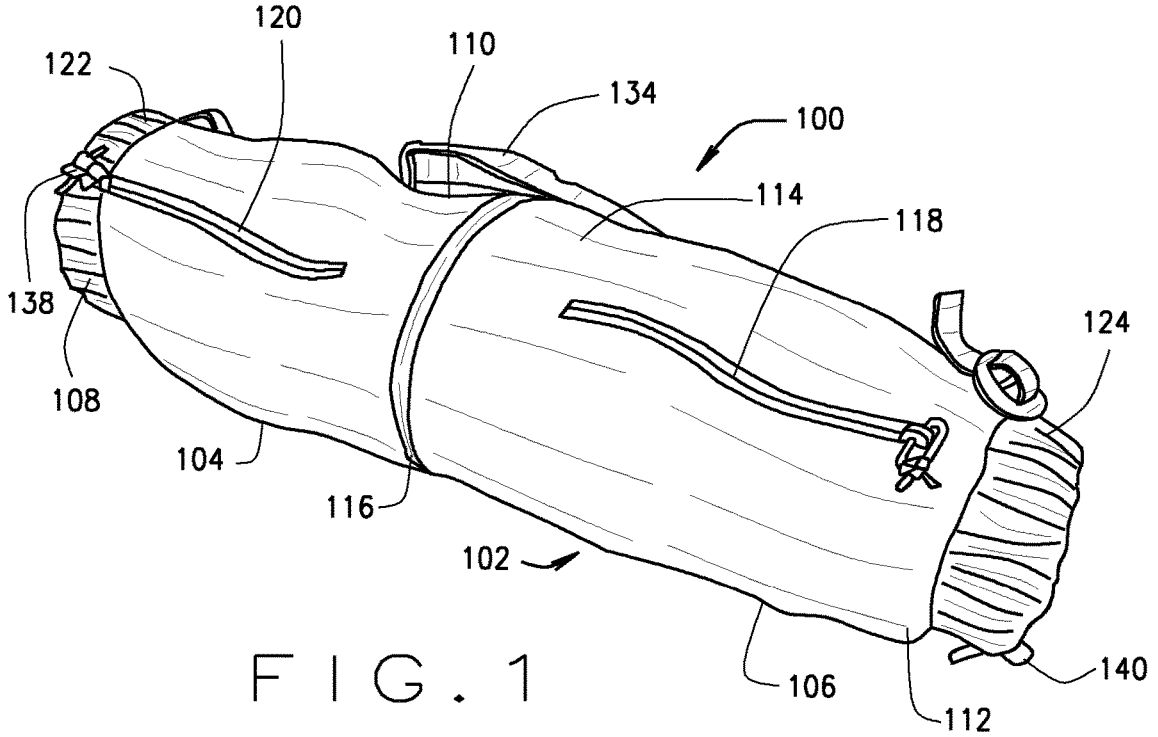
FIG. 1 is a perspective view of a tactical hand warmer apparatus having first and second glove portions secured together.

Embodiments of a tactical hand warmer apparatus having detachable first and second glove portions that allow an individual to warm their hands either separately or closely together within the body of the tactical hand warmer apparatus are disclosed. Referring to the drawings, an embodiment of the tactical hand warmer apparatus is illustrated and generally indicated as 100 in FIGS. 1-10.

Figure 2:
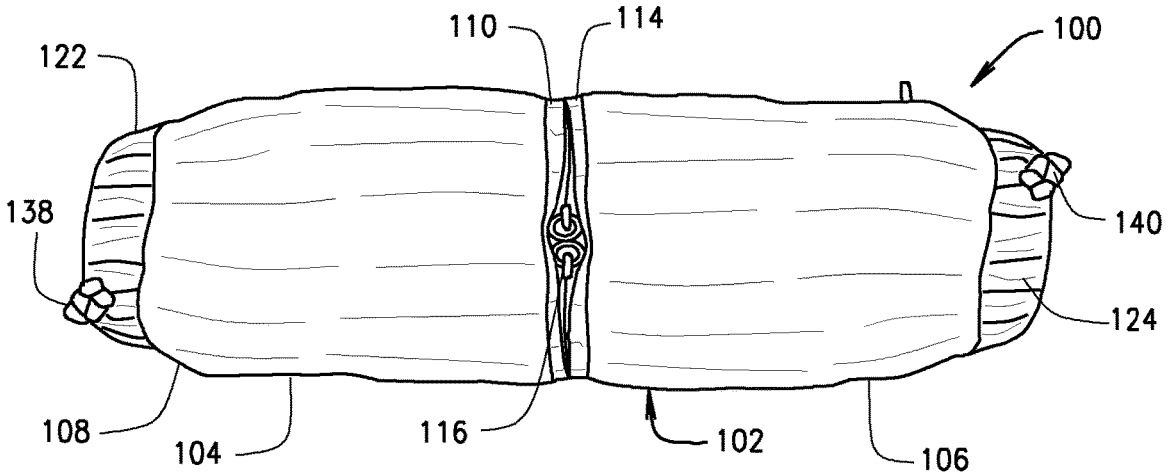
FIG. 2 is a top view of the tactical hand warmer apparatus.

As shown in FIGS. 1 and 2, one embodiment of the tactical hand warmer apparatus 100 includes a detachable body 102 having a first glove portion 104 detachably secured to a second glove portion 106 through a first securing arrangement 116. In one embodiment, the first securing arrangement 116 permits the first glove portion 104 to be engaged or disengaged from the second glove portion 106 when the first securing arrangement 116 is closed or opened to permit an individual to either keep their hands in close proximity to each together within the body 102 of the tactical hand warmer apparatus 100 or maintained apart from each other while still maintaining both hands within the body 102 of the tactical hand warmer apparatus 100.

Figure 3:
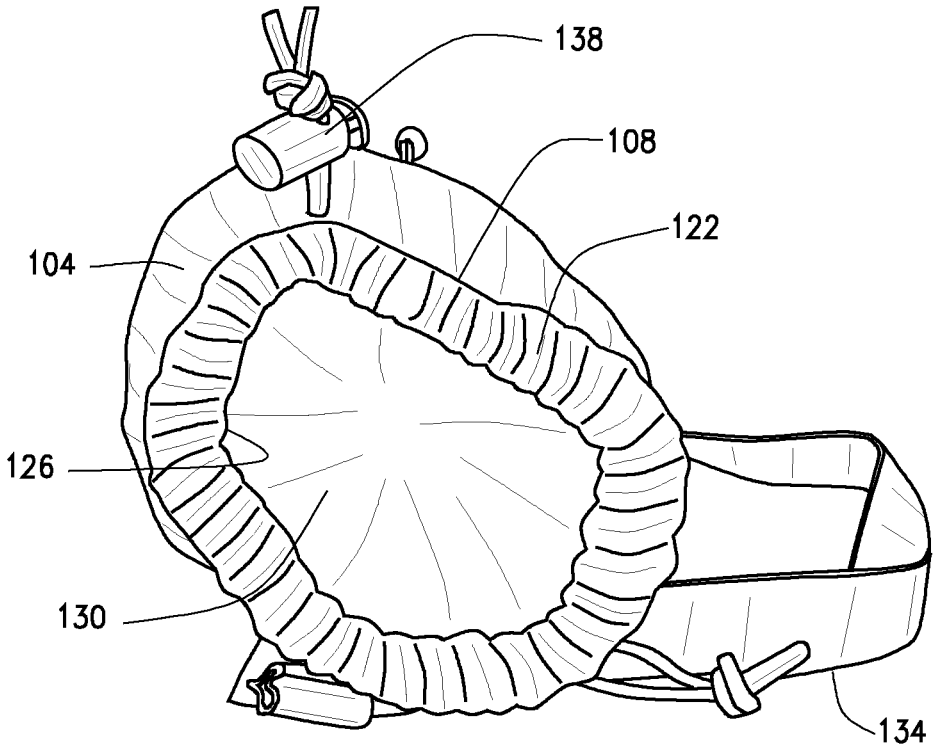
FIG. 3 is an end view of the tactical hand warmer apparatus.
Figure 4:
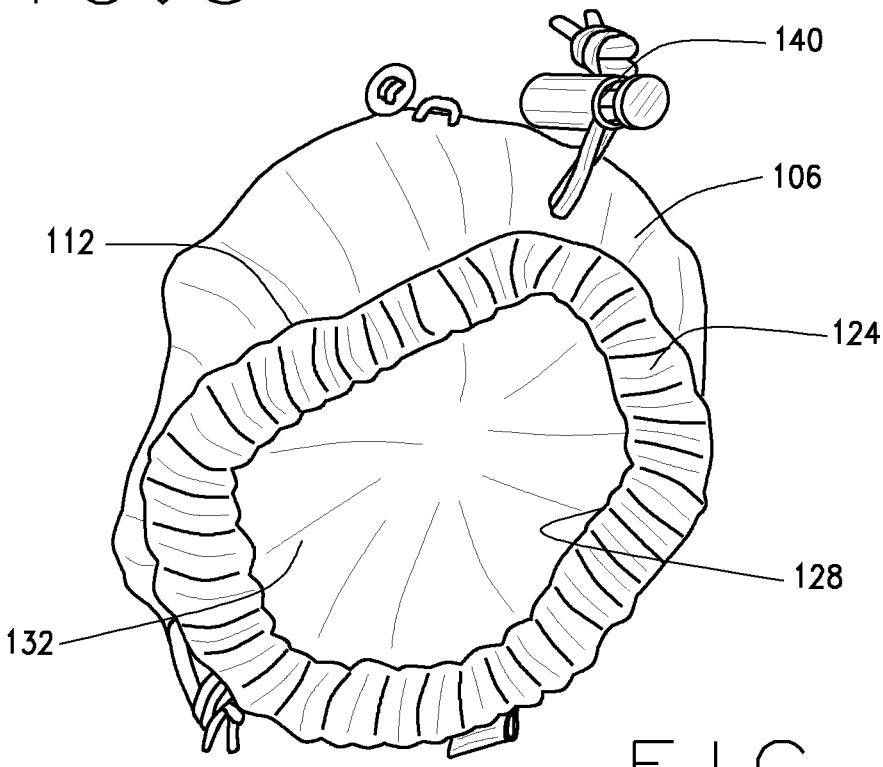
FIG. 4 is an opposite end view of the tactical hand warmer apparatus of FIG. 3.
Figure 5:
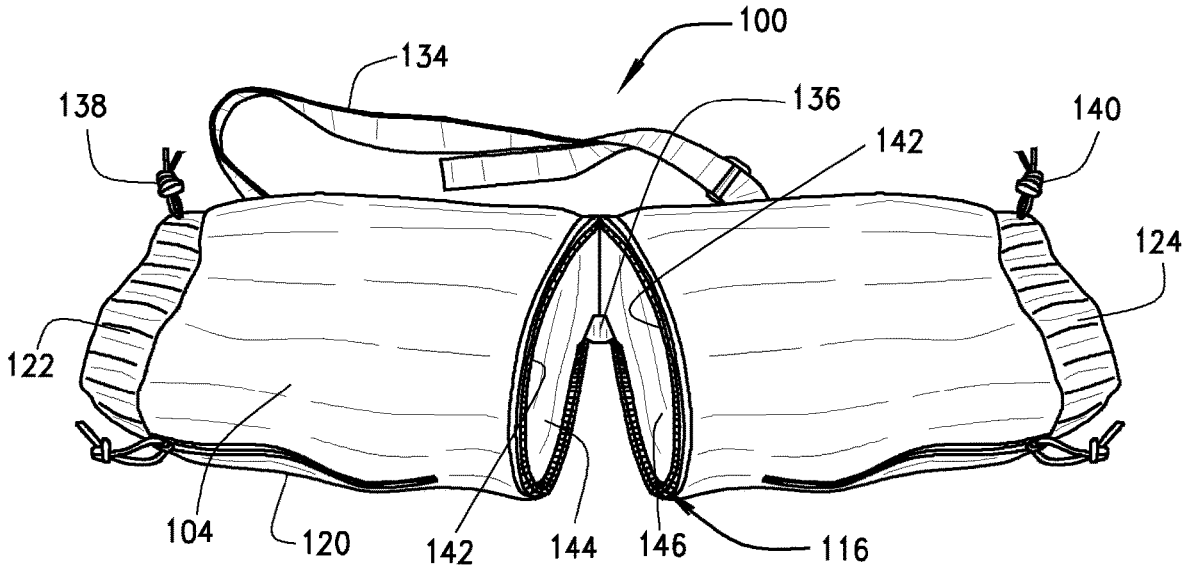
FIG. 5 is an elevated perspective view of the tactical hand warmer apparatus showing the first and second hand glove portions partially secured together.

In one aspect, the first glove portion 104 defines a first open end 108 and a second closed end 110, while the second glove portion 106 also defines a first open end 112 and a second closed end 114. As shown in FIG. 3, the first open end 108 of the first glove portion 104 forms an opening 126 that communicates with a first glove recess 130 configured to receive one hand of an individual. Similarly, as shown in FIG. 4, the first open end 112 of the second glove portion 106 forms an opening 128 that communicates with a second glove recess 132 configured to receive the other hand of the individual. In some embodiments, the first and second glove recesses 130 and 132 may be lined with a felt material, a synthetic fur material, and/or a natural fur material that provide warmth to the hands when disposed within the first and second glove recesses 130 and 132 of the tactical hand warmer apparatus 100.

As further shown in FIGS. 3 and 4, in some embodiments the first open end 108 of the first glove portion 104 defines a first cuff 122 configured to receive a first drawstring 138 that permits the individual to closely draw the first cuff 122 around the wrist of an individual as the first drawstring 138 is drawn closed. Similarly, the first open end 112 of the second glove portion 106 defines a second cuff 124 configured to receive a second drawstring 140 that also permits the individual to closely draw the second cuff 124 around the other wrist of the individual as the second drawstring 140 is drawn closed.

Figure 6:
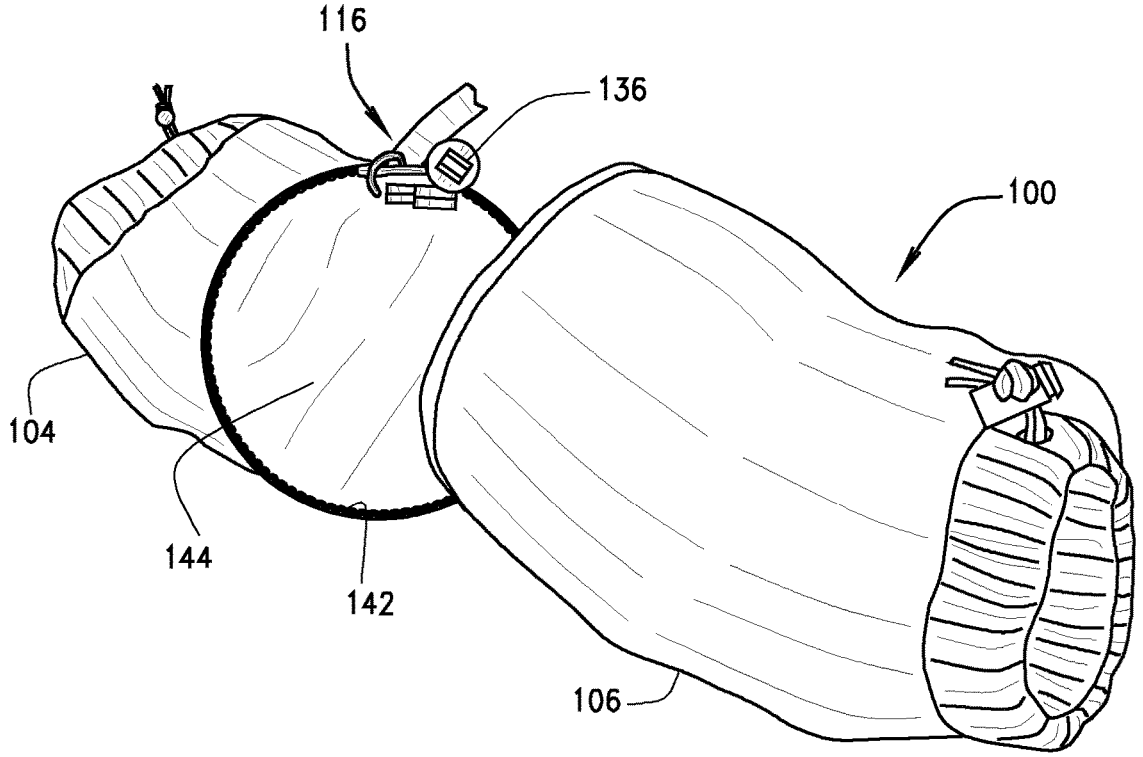
FIG. 6 is a perspective view of the tactical hand warmer apparatus showing the first and second glove portions separated from one another.
Figure 7:
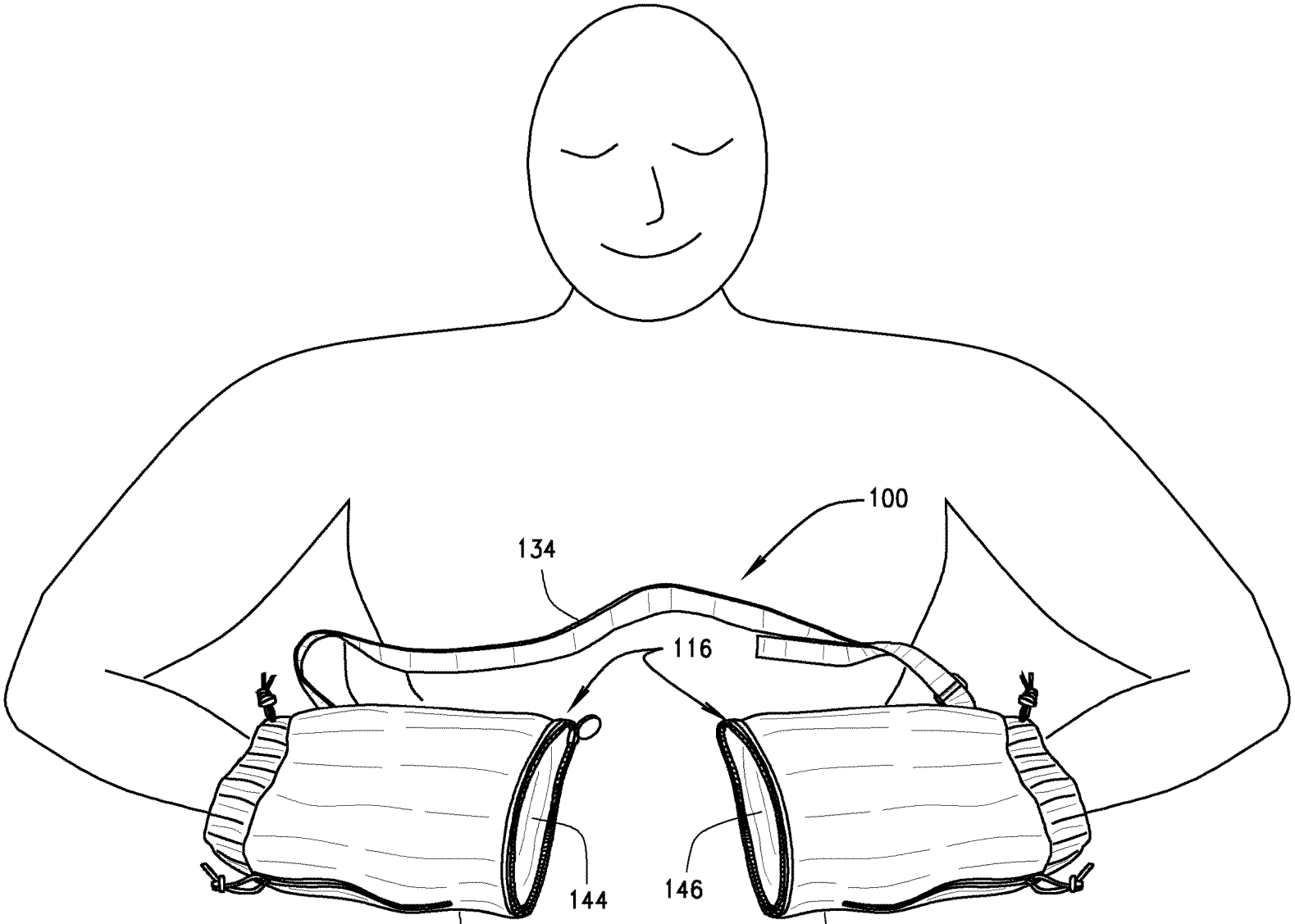
FIG. 7 is a top view of the tactical hand warmer apparatus showing the first and second glove portions separated from one another.
Figure 8:
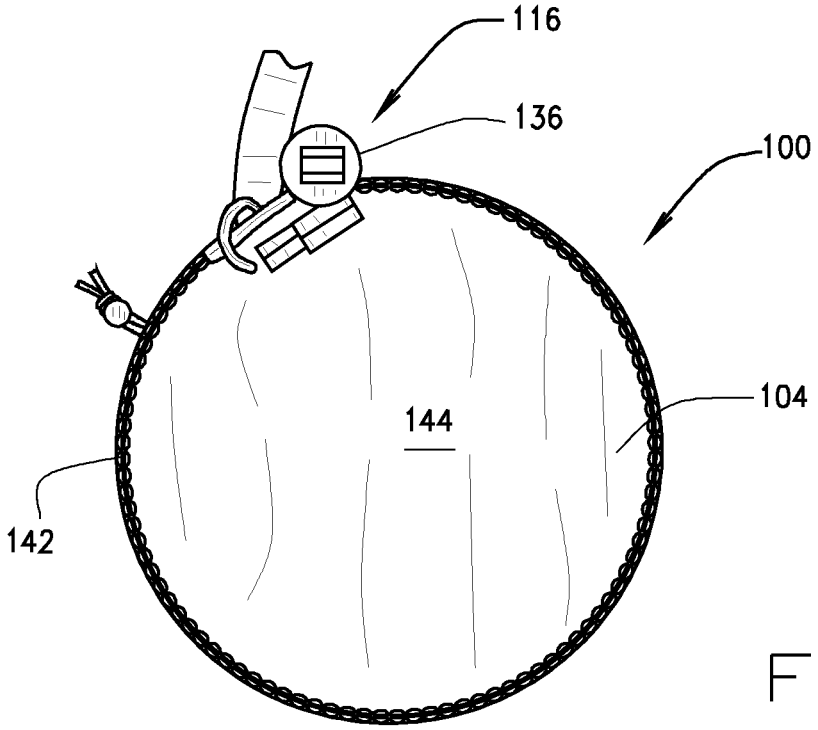
FIG. 8 is an end view of the first glove portion showing a securing arrangement used to couple the first glove portion to the second glove portion.
Figure 9:
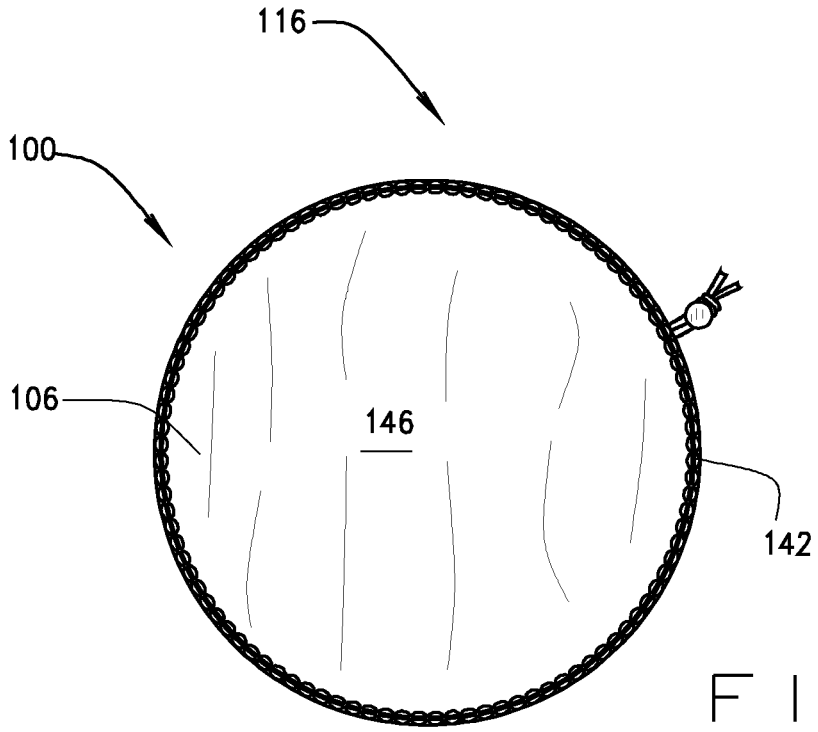
FIG. 9 is an end view of the second glove portion showing the securing arrangement used to couple the first glove portion to the second glove portion.

Referring to FIGS. 5-9, as noted above, in some embodiments the closed first end 110 defining a generally circular-shaped first end portion 144 defined by the first glove portion 104 and the closed second end 114 also defines a generally circular-shaped second end portion 146 of the second glove portion 106 collectively form the first securing arrangement 116 that allows the first glove portion 104 to be engaged and disengaged from the second glove portion 106. In particular, as shown in FIGS. 7 and 8, the first securing arrangement 116 may be a zipper arrangement that includes a set of interlocking protruding teeth 142 formed along the periphery of the first end portion 144 and another set of interlocking protruding teeth 142 formed along the periphery of the second end portion 146. The first securing arrangement 116 further includes a slider 136 that is operatively connected to both sets of interlocking protruding teeth 142 such that movement of the slider 136 in one direction opens the first securing arrangement 116 by disengaging both sets of interlocking protruding teeth 142 and movement of the slider 136 in the opposite direction closes the first securing arrangement 116 by engaging together both sets of interlocking protruding teeth 142. Once the first securing arrangement 116 is fully opened as shown in FIG. 6, the first and second glove portions 104 and 106 may be detached from each other such that each of the individual's hands are separately disposed within the first glove portion 104 and second glove portion 106, respectively, as illustrated in FIG. 7.

Referring back to FIG. 1, in some embodiments the first glove portion 104 may define a second securing arrangement 120 that extends longitudinally between the first open end 138 and the second closed end 110 of the first glove portion 104. Similarly, the second glove portion 106 may define a third securing arrangement 118 that extends longitudinally between the first open end 112 and the second closed end 114 of the second glove portion 106. The second securing arrangement 120 and the third securing arrangement 118 may communicate with a respective internal pouch (not shown) that provides a closable storage area.

Referring back to FIG. 7, in some embodiments the tactical hand warmer may include a strap 134 having one end attached to the first glove portion 104 and the opposite end attached to the second glove portion 106. The strap 134 provides a tether that couples the first and second glove portions 104 and 106 together.

In some embodiments, the first securing arrangement 116 may be a strap and buckle arrangement (not shown) that engages and disengages the first and second glove portions 104 and 106. In other embodiments, the first securing arrangement 116 may be a loop and hook arrangement (not shown), such as VELCRO, that extends around the periphery of the first closed end 144 and second closed end 146, respectively, for engaging and disengaging the first and second glove portions 104 and 106.

Figure 10:
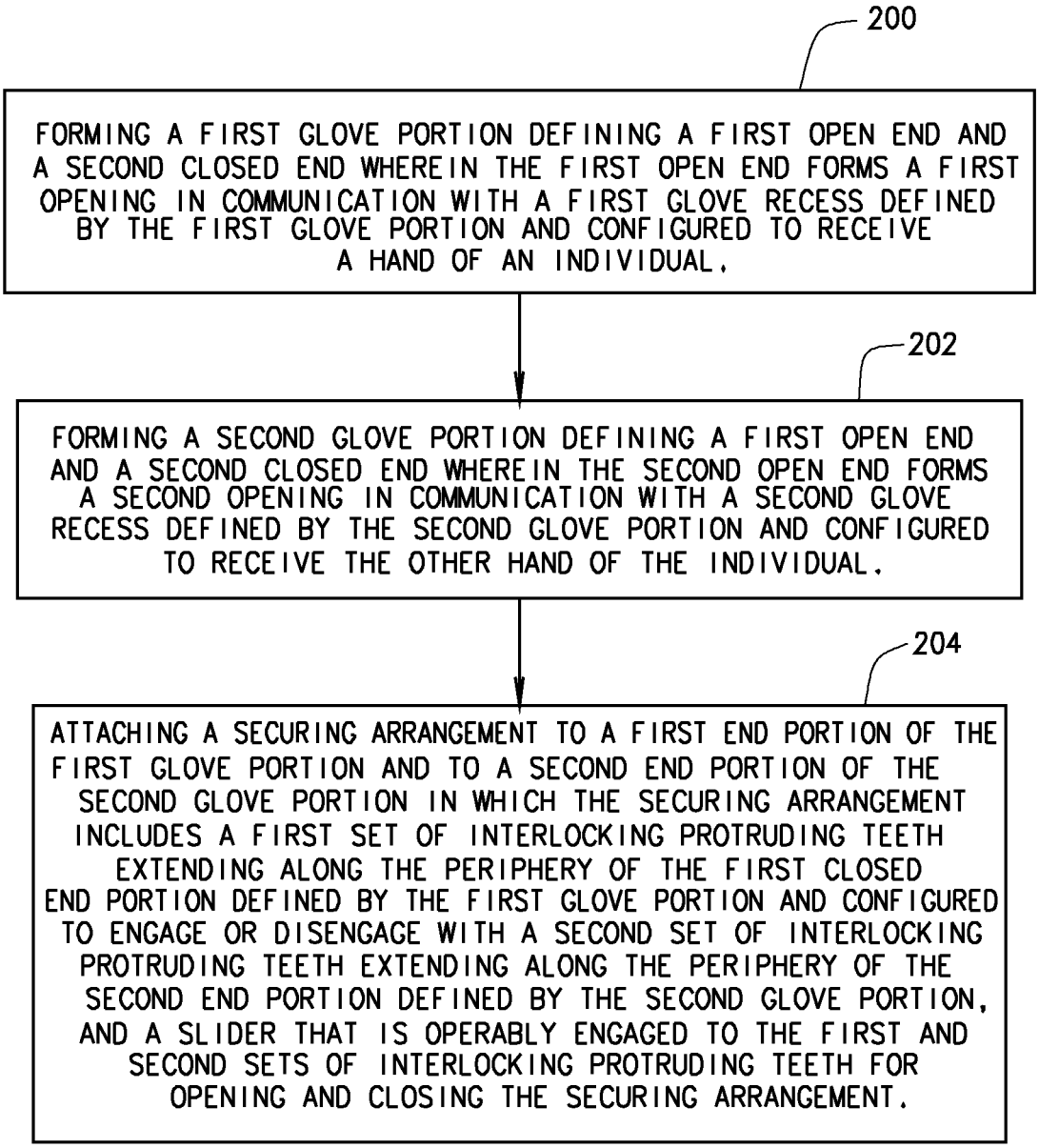
FIG. 10 is a flow chart showing one method of manufacturing the tactical hand warmer apparatus of FIG. 1.

Referring to FIG. 10, a flow chart illustrates one method for manufacturing the tactical hand warmer apparatus 100. At block 200, forming a first glove portion 104 defining a first open end 108 and a second closed end 110 wherein the first open end 108 forms a first opening 126 in communication with a first glove recess 130 defined by the first glove portion 104 and configured to receive a hand of an individual. At block 202, forming a second glove portion 106 defining a first open end 112 and a second closed end 114 wherein the first open end 112 forms a second opening 128 in communication with a second glove recess 132 defined by the second glove portion 106 and configured to receive the other hand of the individual. At block 204, attaching a securing arrangement 116 for detachably coupling the first glove portion 104 to the second glove portion 106 in which the securing arrangement 116 includes a first set of interlocking protruding teeth 104 extending along the periphery of a first end portion 144 defined by the first glove portion 104 which is configured to engage or disengage a second set of interlocking protruding teeth 142 extending along the periphery of the second end portion 146 defined by the second glove portion 106, and a slider 136 that is operably engaged to the first and second sets of interlocking protruding teeth 142 for opening and closing the securing arrangement 116.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A method of manufacturing a tactical hand warmer apparatus comprising:

forming a first glove portion defining a first open end and a first closed end and extending along a first longitudinal axis between the first open end and the first closed end, the first closed end extending transverse to the first longitudinal axis, wherein the first open end forms a first opening in communication with a first glove recess defined by the first glove portion;

forming a second glove portion defining a second open end and a second closed end and extending along a second longitudinal axis between the second open end and the second closed end, the second closed end extending transverse to the second longitudinal axis, wherein the first open end forms a second opening in communication with a second glove recess defined by the second glove portion; and forming a securing arrangement for detachably coupling the first closed end of the first glove portion to the second closed end of the second glove portion.

2. The method of claim 1, wherein forming the securing arrangement comprises:

forming at least one of a buckle arrangement and a hook and loop arrangement configured to engage and disengage the first glove portion and the second glove portion.

3. The method of claim 1, wherein forming the securing arrangement comprises: forming a zipper arrangement comprising:

a first set of interlocking protruding teeth extending along the first closed end of the first glove portion;

a second set of interlocking protruding teeth extending along the second closed end of the second glove portion, the second set of interlocking protruding teeth configured to engage the first set of interlocking protruding teeth; and a slider engaged to the first set of interlocking protruding teeth and the second set of interlocking protruding teeth, wherein movement of the slider in a first direction engages the first set of interlocking protruding teeth to the second set of interlocking protruding teeth, and wherein movement of the slider in a second opposite direction disengages the first set of interlocking protruding teeth to the second set of interlocking protruding teeth.

4. The method of claim 3, wherein the first set of interlocking protruding teeth extends along the periphery of a first closed end of the first glove portion and the second set of interlocking protruding teeth extends along the periphery of the second end portion of the second glove portion.

5. The method of claim 3, further comprising:

forming a first cuff proximate the first open end of the first glove portion; and forming a second cuff proximate the second open end of the second glove portion.

6. The method of claim 5, further comprising:

disposing a first drawstring within the first cuff and disposing a second drawstring within the second cuff.

7. The method of claim 3, further comprising:

forming a first pouch within the first glove portion and forming a second pouch within the second glove portion.

8. The method of claim 3, further comprising:

attaching a second securing arrangement to the first pouch and a attaching a third securing arrangement to the second pouch, wherein the second and third securing arrangements comprise at least one of a zipper arrangement, a hook and loop arrangement, and a buckle arrangement.

9. The method of claim 3, further comprising:

attaching one end of a strap to the first glove portion and attaching another end of the strap to the second glove portion.

10. The method of claim 1, wherein the first longitudinal axis is the second longitudinal axis.

11. The method of claim 1, wherein the first closed end of the first glove portion defines a planar surface.

* * * * *